United States Patent [19]

Bay

[11] Patent Number: 5,045,039

[45] Date of Patent: Sep. 3, 1991

[54] PROGRAM CONTROLLED SHEET FOLDING APPARATUS FOR FOLDING LARGE SHEETS INTO PREDETERMINED FORMATS

[76] Inventor: Otto Bay, Luzernstrasse 45, CH-4553 Subingen, Switzerland

[21] Appl. No.: 399,584

[22] Filed: Aug. 28, 1989

[30] Foreign Application Priority Data

Jun. 16, 1989 [CH] Switzerland ..... 02265/89

[51] Int. Cl.[5] ..... B65H 45/14; B65H 45/18; B65H 45/20

[52] U.S. Cl. ..... 493/1; 493/19; 493/23; 493/419; 493/423; 493/444; 493/458

[58] Field of Search ..... 493/1, 2, 14, 19, 23, 493/25, 29, 419, 423, 444, 458

[56] References Cited

U.S. PATENT DOCUMENTS

| | | | |
|---|---|---|---|
| 3,083,010 | 3/1963 | Salmon et al. | 493/23 |
| 3,363,897 | 1/1968 | Northern et al. | 493/23 |
| 3,437,334 | 4/1969 | Maldonado | 493/23 |
| 3,698,705 | 10/1972 | Funk et al. | 493/23 |
| 3,747,917 | 7/1973 | Roda | 493/419 |
| 3,790,157 | 2/1974 | Crawford et al. | 493/23 |
| 4,338,086 | 7/1982 | Heater | 493/458 |
| 4,484,905 | 11/1984 | Ashburner | 493/419 |
| 4,504,259 | 3/1985 | Lindenmuller | 493/23 |

FOREIGN PATENT DOCUMENTS

| | | |
|---|---|---|
| 0156326 | 10/1985 | European Pat. Off. . |
| 2227582 | 1/1974 | Fed. Rep. of Germany . |

*Primary Examiner*—William E. Terrell
*Attorney, Agent, or Firm*—W. G. Fasse; D. H. Kane, Jr.

[57] ABSTRACT

To fold large sheets of different sizes with different folding patterns, in zig-zag folds, the sheets are introduced into a folding system having first, second and third belts (5, 6, 10) which, between the first, second and third belt define a folding gap. The belts are driven, respectively, in selected directions of rotation to fold a sheet in a zig-zag pattern. A control system (35) having a memory (50) with folding patterns stored therein, is responsive to a sheet-length signal derived, for example, from a printer (75). A stepping motor moves a sheet, in accordance with a selected program stored in the memory, to form the fold based on the length of the sheet. Prior to folding sheet a maybe end-for-end a sheet is flung upwardly in a reversing gap (46) whereupon the sheet is transported by paper removal rollers (44, 48) and transport belts (55, 63) to sheet supply rollers (3) of the folding apparatus.

5 Claims, 7 Drawing Sheets

PROGRAM CONTROLLED SHEET FOLDING APPARATUS FOR FOLDING LARGE SHEETS INTO PREDETERMINED FORMATS

FIELD OF THE INVENTION

The present invention relates to a folding apparatus for folding large sheets into smaller formats in accordance with a folding program, whereby one or more selected fold lines are formed in the sheet. These fold lines are located, with respect to the longitudinal extent of the sheet, at selected longitudinal positions in dependence on the length of the sheet. The apparatus is suitable for association with a printer or a copying machine of sufficient size to supply, for example, drawings, layouts and the like, and to provide the copy on sheets of standard sizes, folded for convenient handling.

BACKGROUND INFORMATION

Folding machines for folding large paper sheets have been proposed in which the paper sheet is fed to a folding system having folding means, for example belts therein, operable in respectively different directions of rotation. A feed roller pair is located ahead of the folding system. The folding system has at least two endless, driven folding belts, wrapped about respective turnaround rollers, the axes of which are in the same plane. A third, endless belt is spaced from the aforementioned belts by a small distance to form a folding gap. A control system is provided for controlling the respective direction of rotation of the belts.

Folding machines of this type are used for example to fold large machine drawings, architectural layouts and the like, and have a substantial structural length. This large space requirement is a disadvantage.

The German Published Patent Application 2 227 582, (Werthebach) describes an arrangement for folding paper sheets utilizing a plurality of folding rollers which, by change in the direction of rotation, cause a sheet fed thereto to be folded. Close to the inlet opening, the paper sheet is caused to form a loop which is gripped by the folding rollers, and is then formed to make a fold. Microswitches are provided which sense the presence of a sheet in a folding gap, and, upon sensing the sheet, cause a change in the direction of rotation of the folding rollers. The folding program, and the position of the folds, that is, the folding length with respect to the longitudinal direction of the sheet, is always the same and cannot be changed.

Published European Application 0 156 326, (Isermann et al.) describes a horizontal folding machine for folding sheets which, in order to measure the longitudinal extent of the sheet, has a measuring roller associated therewith. The measuring roller is coupled to a pulse source. The trailing edge of the sheet is sensed by a sensor remote from the folding mechanisms. Such a structure for handling large sheets, is space-consuming and the folds cannot be selectively predetermined.

SUMMARY OF THE INVENTION

It is an object of the invention to provide a compact folding machine and a control system which will cause the folding machine to automatically fold to be folded a sheet to be folded in accordance with a predetermined folding program, as a sheet is delivered from a copying machine or a printer.

In accordance with a feature of the invention, at least one sensor and a signal generating source are provided for scanning the leading edge of the sheet, and coupled to a control apparatus for controlling the folding operations. The control apparatus includes at least one memory or storage unit to store predetermined folding programs. A signal source, which may form part of a printer or copy machine, provides a signal representative of the respective length of the paper sheet being supplied to the folding apparatus and which is to be folded, the signal being coupled to the memory for recall from the memory the folding program which is associated with sheets of the specific size then being fed to the folding apparatus.

The system permits an automatic association of predetermined folding programs with sheets of different sizes. The length of the sheet determines the sequence of folds during the course of the folding of the sheet.

Information regarding the size of the respective sheet is directly supplied by the printer to the control program of the folding machine. The sizes of the sheets being handled by the printer are standardized and that size information is already available in the printer.

In accordance with a feature of the invention, the space requirement usually necessary for folding machines of this type can be reduced substantially by, preferably, placing the folding machine immediately next to the printer or copy machine, and placing the folding mechanism in a vertical plane, rather than horizontally.

In accordance with another feature of the invention, a turn-over or sheet reversal apparatus can be associated with the folding machine so that any sheet delivered from a printer will be so handled by the folding machine that a drawing heading or information block will be at a selected position on the sheet, for example close to the leading edge, or, if desired, close to the trailing edge of the sheet.

In accordance with the invention, a method is provided to fold the sheet by guiding it with a leading edge in an essentially vertical folding gap. According to another feature of the invention, a method is provided to guide a paper sheet with a leading edge first in an essentially vertical turn-over or reversal gap, removing the sheet from the gap with the trailing edge forward, and conducting the sheet to the folding apparatus in that position so that the originally trailing edge will become the leading edge of the sheet being folded.

The present apparatus and the method have the advantage that the vertical arrangement of the turning-over or reversing gap, as well as of the folding gap, when vertically arranged, will require only little space. The turn-over arrangement, when integrated with the folding apparatus, is particularly economical in use of space. The position of a drawing heading or information box on the folding sheet can then be placed as desired.

BRIEF DESCRIPTION OF THE DRAWINGS

The accompanying drawings illustrate examples of the invention wherein.

DETAILED DESCRIPTION OF PREFERRED EXAMPLE EMBODIMENT

Figure 1:
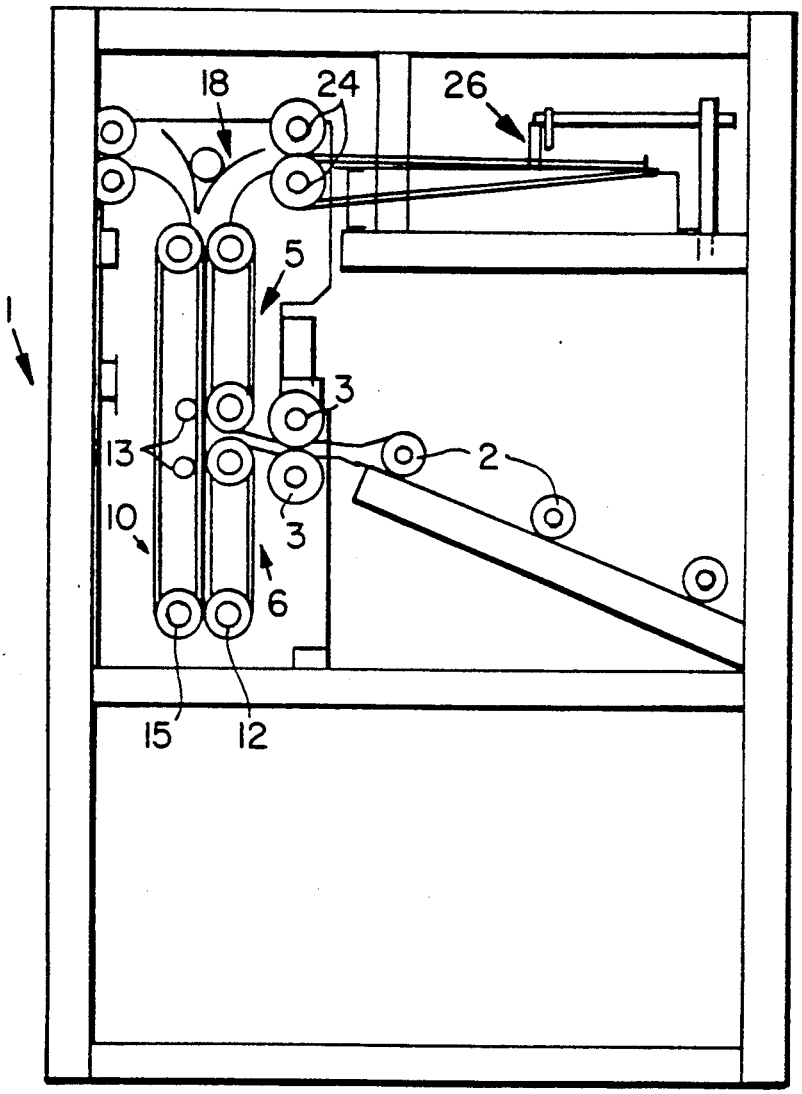
FIG. 1 is a side view of the folding machine.
Figure 2:
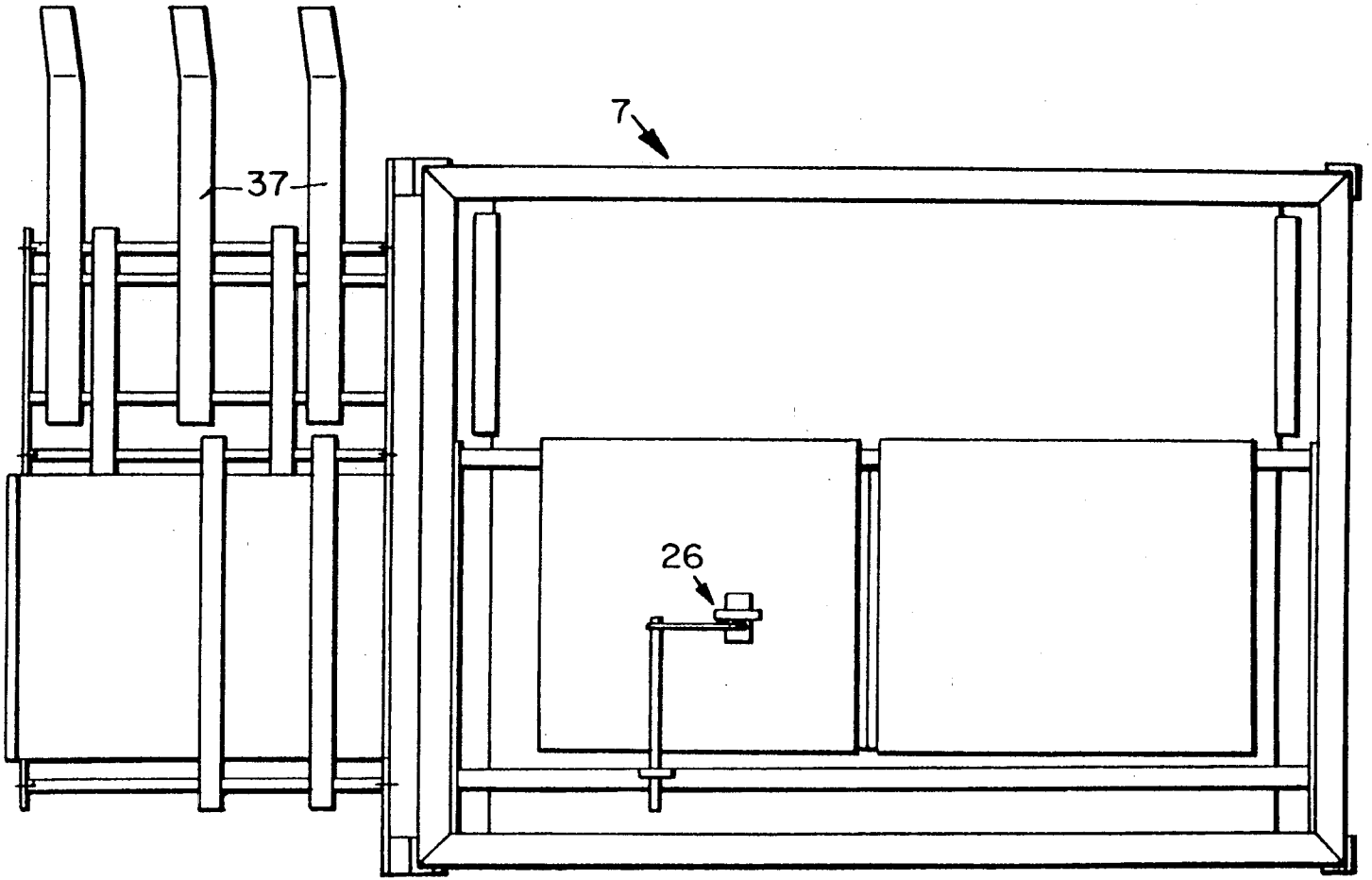
FIG. 2 is a top view of the folding machine.
Figure 3:
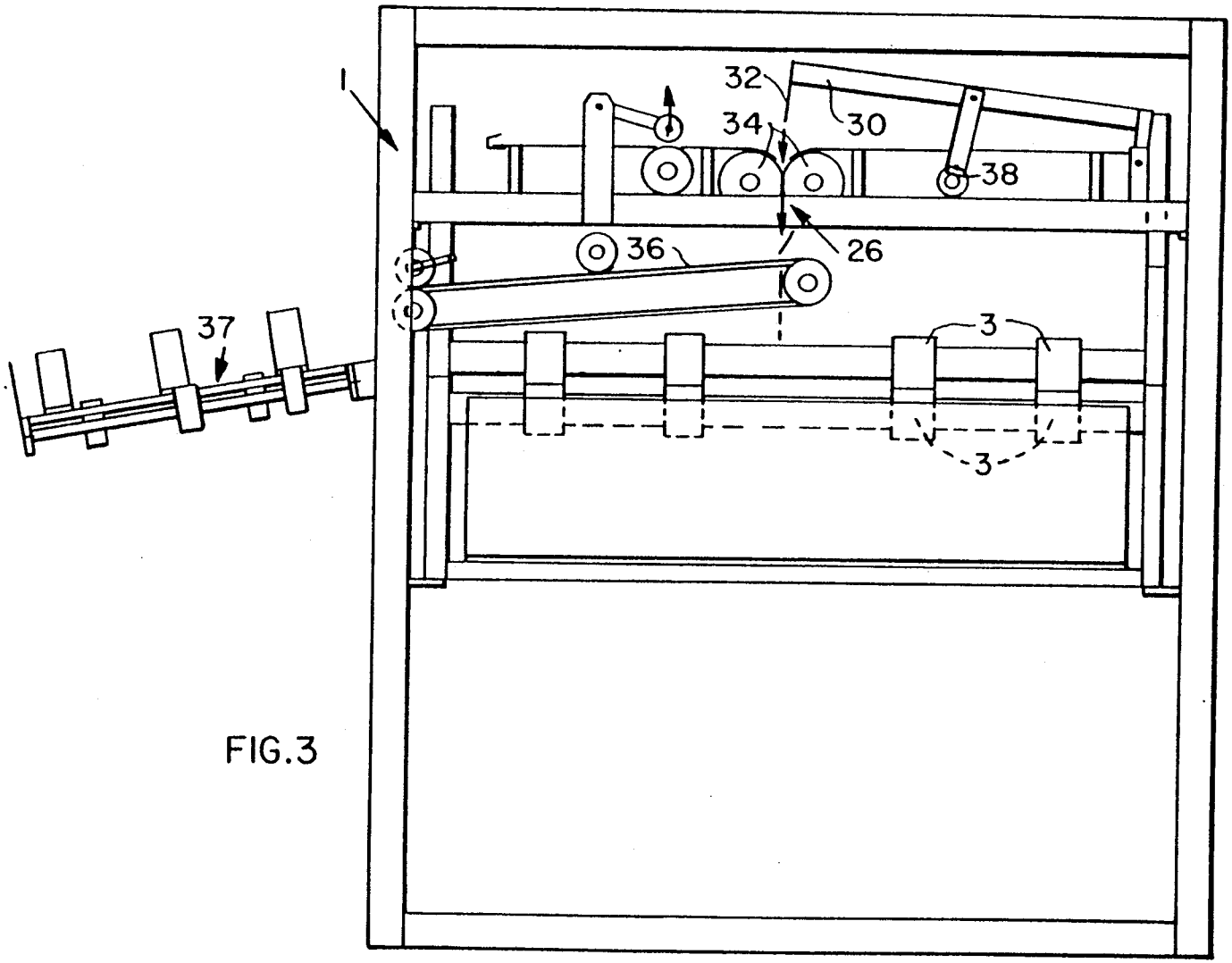
FIG. 3 is a front view of the folding machine.

Referring first to FIGS. 1 to 4, the present folding machine has an essentially block-shaped frame 1, and is intended to be placed next to an output printer, for example a xerographic printer. The apparatus can be coupled to the printer, for example by being hinged thereto. Paper sheets 9 (FIG. 5) delivered by the printer have information thereon. The sheets 9 may be ordinary printer-type output paper, copy paper, transparency sheets or the like. The apparatus of the present invention is particularly adapted for handling large drawings of standardized size which are fed from an output table or rack 2' by a transport roller 2 to a pair of supply rollers 3. A sensor system 4 is located in advance of or behind the supply roller pair 3. The sensor system 4 may be an optical sensor, for example directing a beam of light to a photoelectric transducer, the beam being interrupted by the sheet of paper. Alternatively, a suitable mechanical sensor may be provided for scanning the leading edge 17 (FIG. 5) of the paper sheet 9 is suitable. The supply roller pair 3 is driven by a stepping motor 8'. The supply roller pair 3 clamps the paper sheet 9 within an inlet gap or nip 19, and transports the paper sheet with a predetermined supply speed in the direction of the arrow B (FIG. 4) into a folding region or zone or chamber 7. The folding zone 7 is defined by a group of folding belts, located respectively adjacent each other. The folding region 7 thus is bounded by a first or upper folding belt 5, a second or lower folding belt 6, and a third folding belt 10, running parallel to the folding belts 5 and 6, but leaving a folding gap 14 therebetween. The axes of rotation 11 of deflection rollers 12 about which the endless belts 5 and 6 are looped, are located in a common first vertical plane, and the deflection rollers 12 are all identical.

The third, endless folding belt 10 is longer than the upper and lower folding belts 5, 6, respectively, and extends throughout the longitudinal extent of both the belts 5, 6. The deflection rollers 15 of the third folding belt 10 are spaced from a vertical plane passing through the axes 11 of the belts 5 and 6, and located in a plane parallel thereto. In the region of the folding chamber or zone 7, the third folding belt 10 is supported by resiliently placed counterpressure rollers 13. The folding gap 14 is formed between the respective folding belts 5 and 6 and the third folding belt 10, and extends preferably vertically, or at least approximately vertically. The sensor 4 is located downstream of said folding gap 14.

The axes 25 of the supply roller pair 3 are vertically offset with respect to the neighboring axes of the rollers 12, so that a sheet 9 (FIG. 5) supplied between guides 23 (FIG. 5) meets the third folding belt 10 at an inclination. This facilitates initial deflection of the leading edge 17 of the supplied sheet 9 in the folding region 7 in an upward direction. The folding belts 5, 6, 10 are driven, in common, by a reversible stepping motor 8. The supply rollers 3 are driven by a second stepping motor 8'. The supply rollers 3, normally, will not reverse.

A second sensor 16, scanning the leading edge 17 of the paper sheet 6 is located in the upper region of the folding belts 5 and 10. The second sensor may also be a light gate or a mechanical sensor. The folding belts, preferably, are formed as parallel-positioned belt units, spaced from each other, which provides room for the sensor 16. Rather than using separate folding belt units, spaced laterally from each other, the folding belts 5, 6, 10 may be made of light-transmissive material. The spacing between the sensors 4 and 16 is predetermined.

Figure 4:
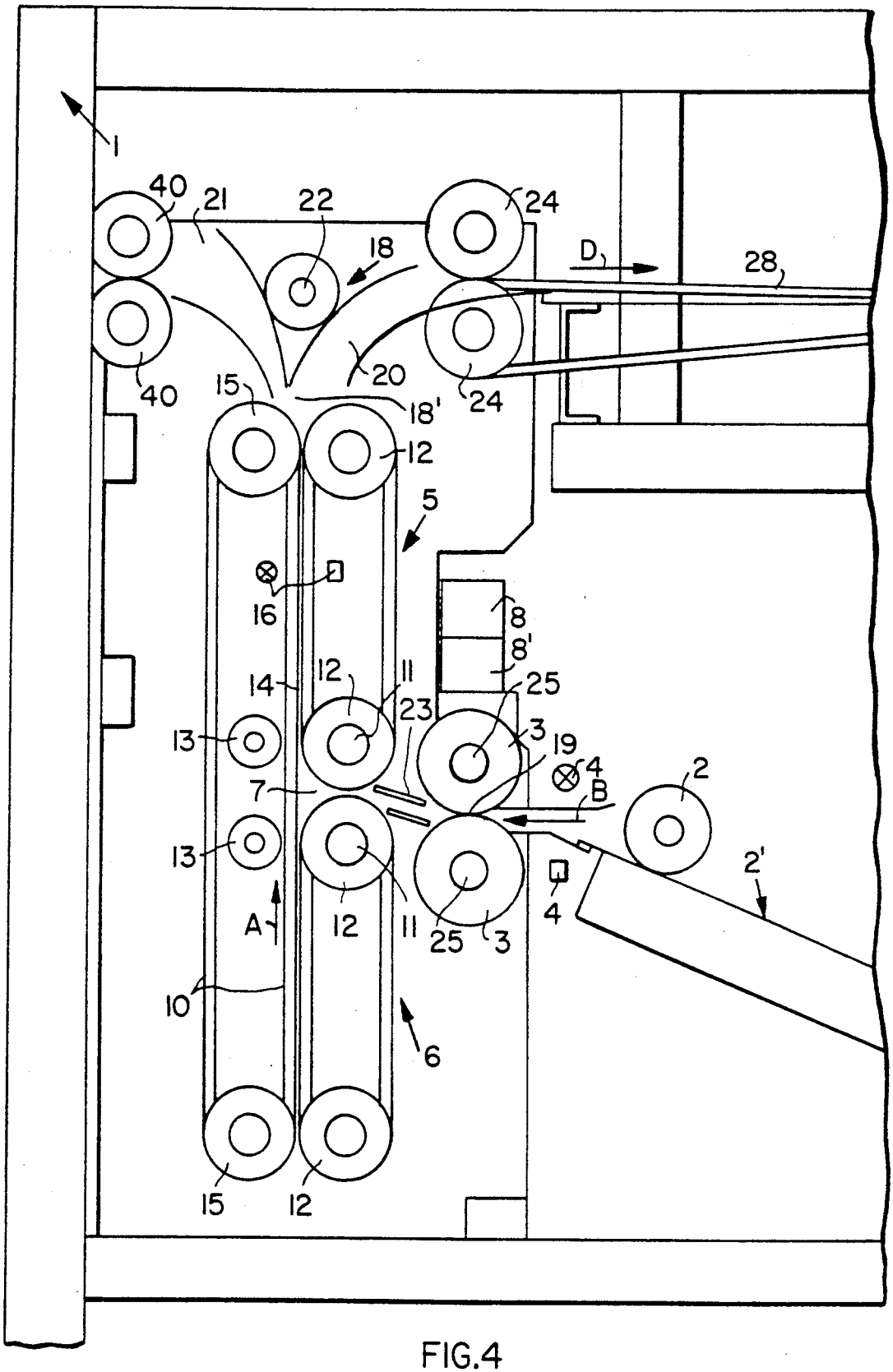
FIG. 4 is an enlarged fragmentary view of FIG. 1, for illustrating the folding system, without a paper sheet therein.

A paper path switch 18 for the sheets, after folding, is located above the outlet zone 18' of the folding belt system 5, 6, 10. In dependence on the switching position of switch 18, the folded sheet 9 is guided into a duct 20 or a duct 21. The switch 18 can be rocked about a horizontal axis 22, for example by an electrically controlled solenoid or the like, which engages a rocker arm (not shown) radially extending from a shaft rotatable about an axis 22. FIGS. 1 and 4 illustrate the switch 18 in the position guiding a sheet through the duct or channel 20. The folded sheet 42 (FIG. 6) is passed through two feed rollers 22 on a transport belt 28 leading to a transverse or cross folding system 26. The cross folding system 26 (FIGS. 1, 3) has a folding blade 32 secured to a pivotably supported arm 30. Blade 32 is positioned to push a sheet between two transverse folding rollers 34. Upon operation of the blade 32, the sheet folded in the folding belt system 5, 6, 10 receives a cross fold. The blade 30 is operated by an eccenter 38. The additionally cross folded sheet 42 is fed to a removal belt 36 for retrieval from output bins 37.

The cross folding system 36 is located in the space above the region of the paper supply table 2' and the transport roller 2. Thus, the longitudinal extent of the overall system is small.

If the switch 18 (FIGS. 1, 4) is in a position not shown, the prefolded sheet 9 is guided into the duct 21, gripped by rollers 40 and transported to an output table, a bin, or the like (not shown).

Basic folding operation

Figure 5:
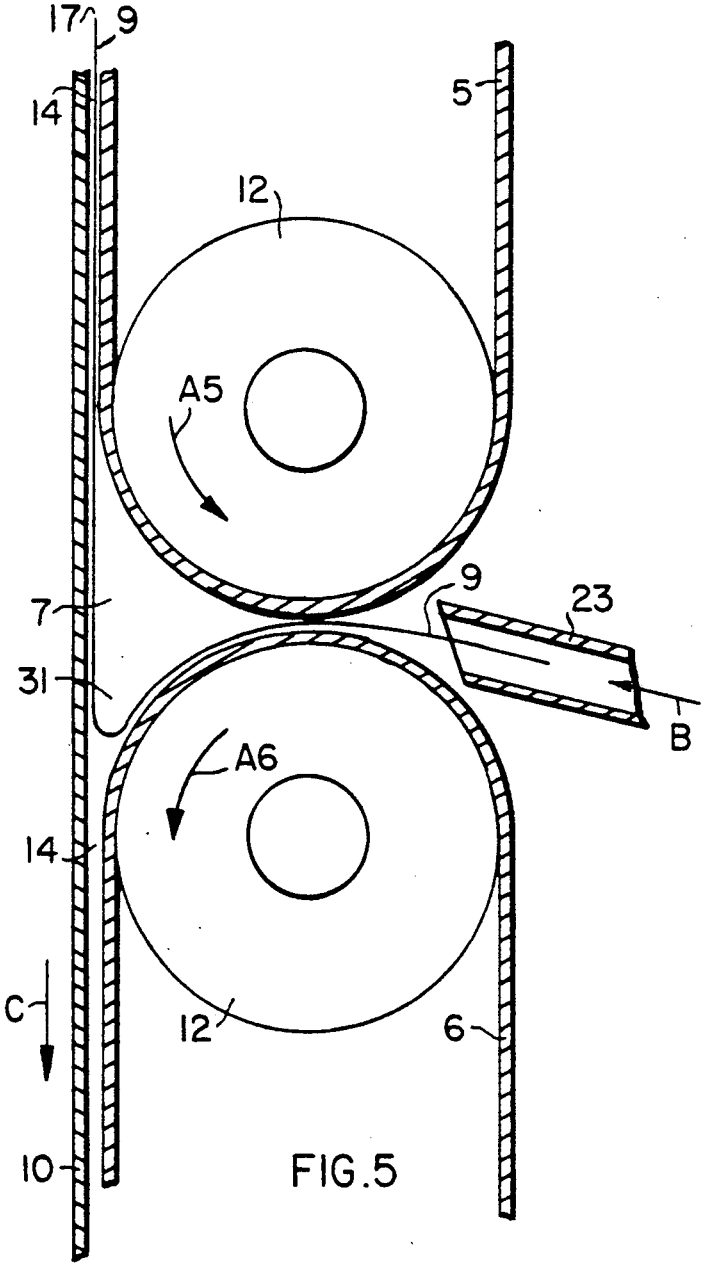
FIG. 5 is a fragmentary side view of the system of FIG. 4, in a vertical section for illustrating the path of a sheet of paper being folded.

A printer 76 (FIG. 7), and more particularly an electrostatic-type printer, delivers a flat paper sheet of standardized format on which, for example, drawings, layouts, circuit diagrams and the like are visibly printed. The sheet is supplied to the input supply table 2' by the input supply roller 2. The sensor 4 determines the supply of the sheet by sensing the leading edge 17 of the sheet 9. The sheet 9 is then transported by the supply rollers 3 in the direction of the arrow B (FIG. 5) and is fed between the guides, for example sheet-metal elements 23, into the folding region or chamber 7. Belts 5 and 6 are driven in the direction opposite the arrows A5, A6 (FIG. 5). Belt 10 is driven in the direction opposite the arrow C of FIG. 5. The leading edge 17 and the adjacent region of the paper web 9 is gripped by the belts 5, 10, both moving in the direction of the arrow A (FIG. 4). This operation feeds the paper sheet 9 into the folding gap 14 in an upward direction.

Figure 7:
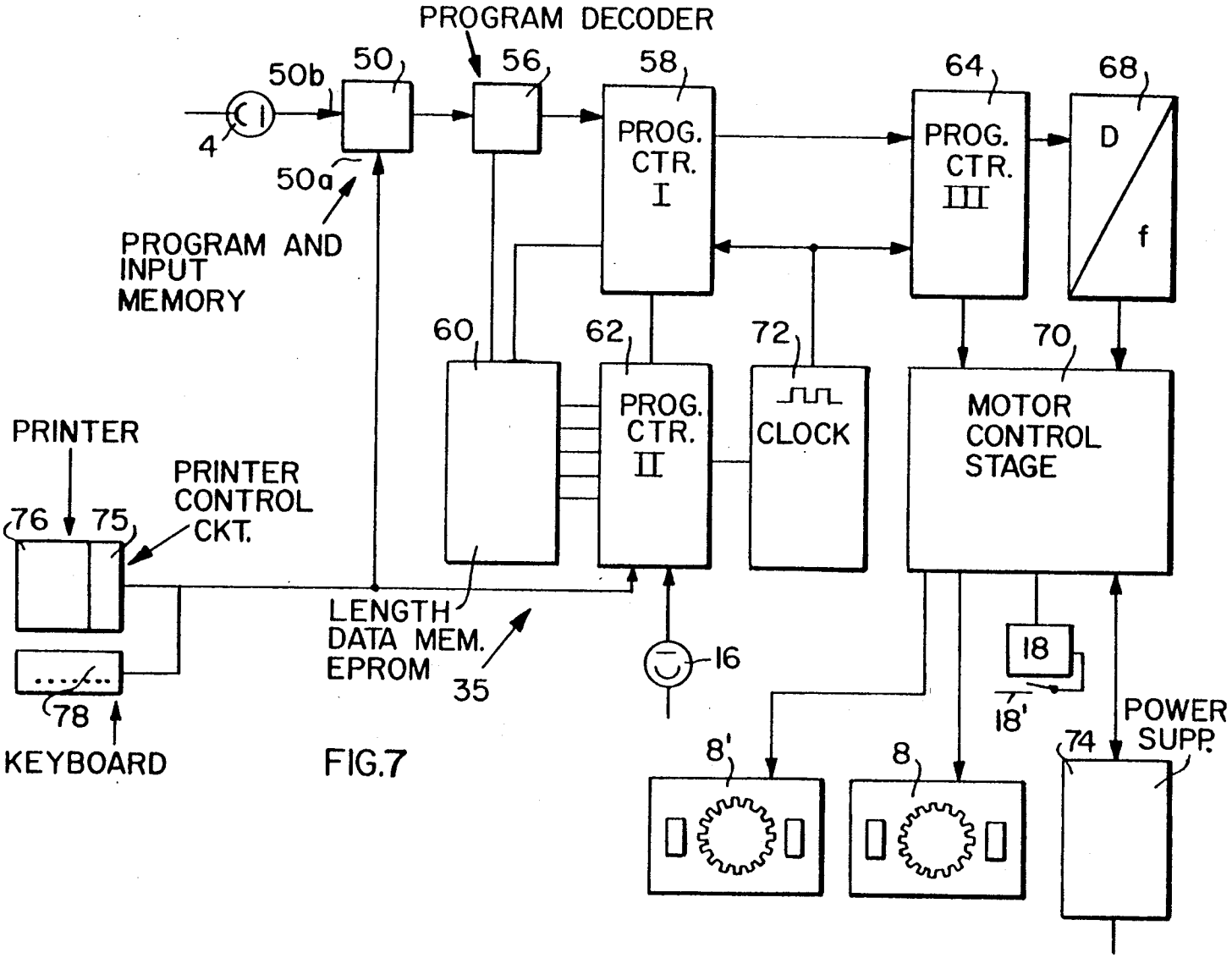
FIG. 7 is a block diagram illustrating the control system for the apparatus.

In accordance with a feature of the invention, the presence of the leading edge 17 of the sheet 9 in the folding gap 14 is sensed by the second sensor 16 and, as soon as the leading edge is sensed, the second sensor 16 generates an initiating impulse to execute a preprogrammed electronic folding program. In dependence on the initial pulse, the folding belts 5, 6, 10, driven by the stepping motor 8, will be moved in accordance with stepping pulses applied to the stepping motor 8 by the electronic control system 35 (FIG. 7). The electronic control system 35 will provide the stepping motor 8 with a predetermined number of stepping pulses in accordance with a specific folding program.

When the paper sheet 9 in the folding gap 14 has reached a predetermined position, for example as defined by counted stepping pulses of the stepping motor, the electronic control circuit 35 (FIG. 7) controls the reversal of the direction of movement of the folding belts 5, 6, 10, so that they will rotate in the direction of the arrows A5, A6 shown in FIG. 5, and belt 10 will operate in the direction of the arrow C. This moves the paper sheet in the folding gap 14 downwardly, counter the direction of the arrow A, FIG. 4, and since the paper continues to be fed by the supply rollers 3 in the direction of the arrow B, the downwardly moving sheet will be bent or creased at 31 (FIG. 5), which will reach the region of the lower folding belt 6. The stepping motor 8' driving the supply rollers 3 does not change direction of rotation. The feeding speed of the paper sheet 9 through the supply roller pair 3 and the linear speed within the folding gap 14 are the same.

A first crease or fold will be formed when the region of the crease or bend 31 is gripped by the lower folding belt 6 and the counter folding belt 10. The downward movement of the folding belts 5, 6, 10 in the direction of the arrow C, with the paper sheet 9 within the folding gap 14, is continued until a predetermined length of the fold along the longitudinal dimension of the sheet is reached, as determined, for example by counting pulses being applied to the stepping motor 8. The length is determined by the electronic control circuit and controlled by the number of pulses applied to the stepping motor 8. Thereafter, the direction of rotation of the belts 5, 6, 10 is changed again and the belts are so moved that the paper sheet 9 in the folding gap 14 is again moved in the direction of the arrow A (FIG. 4). A second fold, directed opposite to that of the fold or bend 31, will form within the folding chamber 7, and a second crease can be formed between the upper folding belt 5 and the folding belt 10.

Figure 6:
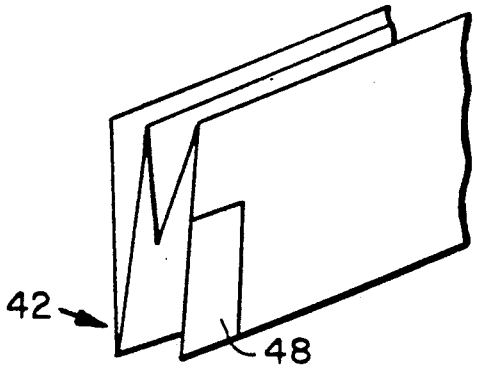
FIG. 6 is a schematic perspective view of a folded sheet, expanded for ease of illustration.

Additional zig-zag folds can be made by repeating the above-described sequence, and merely changing the direction of rotation of the rollers 12, that is, the direction of movement of the belts 5, 6, 10. The intermediate folds can be shorter than the first folds. FIG. 6 illustrates a folded product, expanded for ease of illustration.

A zig-zag form folded sheet 42 with five zig-zag folding operations is shown in FIG. 6. The folded sheet 42 is shown expanded. However, when the folded sheet is delivered from the folding machine, the folds are close against each other.

The folding sequence is so carried out that a drawing heading 48 is always on a cover sheet, and thus also visible when the sheet is folded.

After the last folding process, the folded sheet 42 is ejected from the folding gap 14 in an upward direction. Depending on the position of the switch 18, either channel 20 or 21 will be open. If the electronic control circuit is so positioned that the channel 20 is open, the folded sheet 42 is gripped by the transport rollers 24 and transported to the cross fold system 26. When the folded sheet 42 is located in the cross fold system 26, the eccenter 38 coupled to the arm 32 is driven and the folding blade 32 presses the folded sheet 42, transversely to its prior folds, through the cross fold rollers 34. The now cross-folded sheet 42 is placed on the transport belt 36 for supply to the removal bins 37, a removal table, or any other suitable structure.

If no cross fold is necessary or desired, the switch 18 is so set that the channel or duct 21 is open, and the folded sheet 42 is gripped by the output rollers 40 and supplied to a table, a bin or the like (not shown).

The present folding apparatus is particularly suitable for combination with a turning system 39 (FIG. 8) to turn over a sheet 9. The turning system permits supplying the sheets 9 to the folding machine so that the folding machine will fold them in such a way that the cover page or a cover or heading element 48 (FIG. 6) is always visible, independently of the output from the printer, that is, whether the printer supplies the sheet with a drawing thereon at the leading or trailing end thereof.

Figure 8:
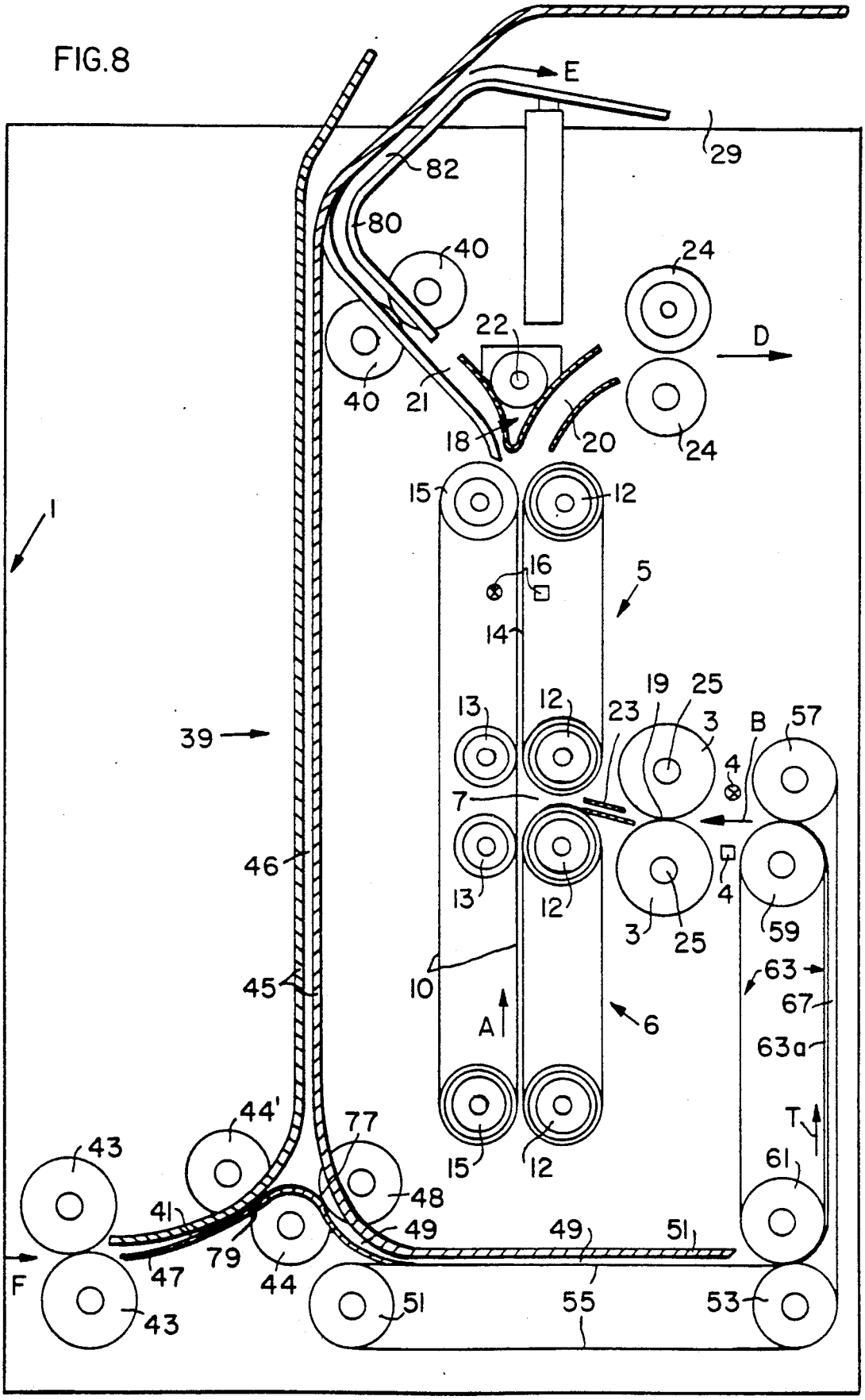
FIG. 8 is a side view, partly in section, of a sheet turn-over or reversing unit, coupled to the folding apparatus.

The folding machine of FIG. 8, in general, is similar to that previously described and is shown with the same reference numerals to illustrate the association with the sheet turning system 39.

If the sheet is to be turned in the turning system 39, the sheet is supplied from the printer in the direction of the arrow, through a gap formed by a pair of transport rollers 43, to thereby feed the sheet into an inlet duct 41. The inlet duct 41 includes a curved guide sheet, for example a sheet-metal element 47, which guides the sheet into a clamping gap 79 between a second pair of transport rollers 44 and 44'. The transport rollers forming a 44, 44' guide the sheet into an essentially vertical or at least approximately vertical turning gap 46, formed between a pair of parallel guides 45, such as guide plates. The gap 46 is open at the top and narrow, and extends above the folding apparatus. The paper sheet is fed into the turning gap 46 upwardly with some speed. After it leaves the transport roller pair 44, 44', it is still flung upwardly until, due to its own weight, it drops down. The guide sheet 79 is so shaped that, upon vertical drop-down, the sheet will fall in the gap 77 between transport roller 44 and a further transport roller 48. The two transport rollers 44, 48 then feed the sheet into the transport duct 49 between a horizontal surface 51 and a first endless transport belt 55 to a roller pair 53, 61. The transport belt 55 is guided about rollers 51, 53, 57, 59 and 61. At the rollers 53, 61, the sheet is deflected from the horizontal direction into the vertical direction, to be then transported in the direction of the arrow T upwardly into a vertical transport gap 47 formed between belt 55 and a second belt 63. Belt 63 is wrapped about two vertically placed rollers 59, 61, positioned in vertical alignment and slightly offset from the axes of rollers 57, 53, as best seen in FIG. 8. The run **63*a* of the transport belt 63 is parallel to the adjacent run of the transport run 55. The belts 63, 55 operate at the same speed. Both the speed and the direction as the sheet is fed, are identical and, hence, the sheet will be transported into the gap 67 between the run 63*a* and the adjacent vertical run of the transport belt 55. At the upper end of the transport belt 63, which is roughly at the same level as the inlet gap 19 of the two supply rollers 3, the sheet is delivered between the rollers 57 and 59, and fed in the direction of the arrow B to the supply roller pair 3 thereby interrupting a light beam or triggering the sensor 4. Folding, as previously described, will then be carried out in the folding system by the belts 5, 6, 10**

After completion of the folding, the folded sheet 42, in dependence on the position of the switch 18, is directed along arrow D to the cross fold system 36 or in a duct 82 in the direction of the arrow E to a delivery region 29, for example a bin, a table or the like.

The folding machine can be operated, selectively, with or without the turn-over system 39. To permit such selective operation, rollers 57 and 59 are movably supported in the frame so that they can be placed out of the position shown in FIG. 8, for example by being dropped, or can be tilted together with the respective transport belts 63 into a non-operated position, thereby permitting the free feeding of sheets from the table 2' through the rollers 2 and hence past sensor 4 to the supply rollers 3.

The paper directing switch 18 is located at an exit region or exit zone 18' from the folding gap 14, for directing the sheet into the exit zone, selectively, to the cross folding system 26 (FIG. 1) or to the exit duct 21 having removal rollers 40 (FIG. 8) in accordance with the arrow E. The position of the switch 18 can readily be controlled by the control system 35, for example in accordance with data stored in a memory 50. A manual override switch 18' is provided, for example to permit manual switch-over of the mechanical switch 18 if it is desired, for example, to interrupt the cross folding operation, for example to check zig-zag folded sheets.

Referring now to FIG. 7, the light gate 4 is connected to an input **50*b* of a program and input memory 50. The program and input memory 50 is further coupled with an input 50*a* to the output from the printer 76 having a control circuit 75 which, as is customary in such types of apparatus, contains format information in electronic form. In addition, a manual input panel or keyboard 78 can be provided to enter format information. The program and input memory 50 is connected to a program decoder which receives information from a length data memory 60, typically an E-PROM. The program decoder is coupled to a first program counter 58. A second program counter 62 receives program data information from the length data memory 60 and, likewise, from the printer control circuit 75. Program counter II, 62, further, is coupled to receive a pulse from the second sensor 16. The entire system is controlled by a clock 72**.

The first program counter 58 is connected to a third program counter 64 which, in turn, is connected to a digital data/frequency converter 68. The data/frequency converter 68 controls a motor control stage 70 which provides the motor pulses to the stepping motor 8, to the stepping motor 8', and, if desired, to control the switch 18. Power is derived from a power supply unit 74.

The control system operates as follows.

When the leading edge of a sheet reaches the sensor 4, an initiating "edge present" pulse is generated which is transmitted to the input **50*b* of the input memory. Since the input 50*a* is connected to the printer via the printer control circuit 75, the information from the printer control circuit is now entered into the program and input memory 50, so that the information relating to the sheet then being handled and fed by the supply rollers 3, is provided to the program and input memory 50. The program decoder 56, coupled to the program and input memory 50, receives information from the length data memory in the form of the E-PROM 60. The length data memory contains data representative of the number of folds and the course of each fold. The requisite coded number of steps to carry out the respective program is then loaded into the second program counter 62** which counts those portions of the folding program which are invariable, and controls the run of this part of the program.

The first program counter 58 is coupled to the third program counter 64 which controls the direction of rotation of the stepping motor 8. Program counter 64 also controls the digital-to-frequency converter 68 which is connected to the program control stage 70, for supplying the stepping motors, and specifically the stepping motor 8, which is reversible.

After the memory is enabled by the pulse from sensor 4 at input **50*b*, and the specific program, depending on length, is selected in the program and input memory 50 by data from the printer 76 via the printer control circuit 75, the paper is fed into the folding gap until it meets the sensor 16. When sensor 16 provides an "edge present" pulse, it is applied to the program counter 62. Program counter 62 also receives information regarding the length of the sheet 9 from the printer 76 via the printer control circuit 75. Program counter 62 counts backwardly, under control of the clock from oscillator 72, and the thus entered program is carried out through the requisite number of steps by stepping motor 8, running in either direction, and thereby moving the belts 5, 6, 10 up and down, to move the paper in engagement with the belts and hence effect sequential zig-zag folds, as is well known in folding apparatus of this type. Thus, the program is carried out by sequential forward and backward control of the stepping motor 8. At the same time, the input or supply rollers 3 are driven by the stepping motor 8'** in the same direction.

When all the program folds based on the program in the memory 50 are carried out, the counter 62 will have reached zero, which, via the other counters 58, 64, causes the belts to move the paper upwardly and eject the now folded sheet from the folding gap 14 into region 18' so that, in dependence on the product switch 18, they are conducted either by belt system 28 to the cross fold unit 26 or via an output roller pair 40 to an output table or bin.

The E-PROM 60 contains the information regarding the length of fold elements for the respective folding programs; the third program counter 64 basically generates the signals which control the direction of operation of the stepping motor 8 for the requisite number of steps which correspond to a given distance of movement of belts 5, 6, 10, and hence controls the length of the folded flaps.

The printer 76 and the printer control circuit 75 provide an output signal representative of the length of the just delivered printed sheet. The printed sheet 9 can then run directly from the printer 76, automatically, via the input system 2, 2' to the input or supply rollers 3, without requiring any manual intervention. Under some conditions, for example upon first starting of the folding machine, or if the printer is located spatially removed from the folding machine, for instance located in another room, manual input relative to the length of a paper sheet is possible by the keypanel or keyboard 78. Keyboard 78 is a signal output system which, for example by operating a key or button, generates the same signals as those generated by the printer control circuit 75. Interfaces makes sure that the signals from the printer control circuit 75, the keypanel 78, and the remainder of the control system are compatible. Such interfaces have been omitted from the drawings since they are well known and can be located in accordance with standard engineering practice. Various normalized lengths of the paper sheet can be stored in the keypanel 78 so that they can be addressed, for example by operation of a single button or key.

Various other arrangements may be made for the operating system 35 of FIG. 7. The units illustrated in FIG. 7 in schematic or block form are commercially available components. The important feature is to store folding programs in a memory for folding in predetermined patterns printed sheets of different lengths, and to recall from the memory that program which is associated with a specific printed sheet then being handled and supplied by the printer 75 to the folding apparatus. The sequence of folding in accordance with the memory stored program is controlled when the leading edge of the sheet generates a specific signal. In the example shown, the signal from sensor 16 initiates the run of the specific program based on the specific length of the sheet in accordance with stored data.

Various changes and modifications may be made, and any features described herein may be used with any of the others, within the scope of the appended claims.

I claim:

1. An apparatus for folding large, essentially rectangular sheets (9) by forming one or more fold lines across the sheet, comprising a folding system (5, 6, 10) for folding said sheets, a pair of driven sheet supply rollers (3) for feeding sheets in a feeding direction (B) into said folding system, said folding system including a first belt means (5) operating in a first plane, a second belt means (6) longitudinally spaced from said first belt means and operating essentially in said first plane, a third belt means (10) operating in a second plane, parallel to said first plane, spaced therefrom for defining a folding gap (14) between said planes, reversible drive means (8, 8') coupled to said belt means for driving said belt means, and control means (35) for controlling an operation of said drive means for selectively reversing a travel direction of said belt means, a first sensor (4) located upstream of said folding gap (14), as viewed in said sheet feeding direction (B) of a sheet moving from said sheet supply rollers (3) into said folding gap (14), said first sensor (4) providing a first "edge present " signal, a second sensor (16) located at a predetermined distance downstream of said first sensor (4) also as viewed in said sheet feeding direction (B), said second sensor (16) providing a second "edge present" signal, conductor means connecting said first and second sensors (4, 16) to said control means (35) for supplying said first "edge present" signal to said control means (35) to initiate an introduction of a sheet into said folding system and for supplying said second "edge present" signal to said control means (35) for initiating a drive control, said control means comprising a memory (50) having stored therein a plurality of folding programs for defining the number and position of fold lines on a sheet depending on a longitudinal dimension of a sheet, said control means further including signal generating means (75, 78) for providing a sheet length signal representative of the length of a sheet for selecting one program out of a number of programs stored in said memory (50) in accordance with said sheet length signal and in response to at least one of said "edge present" signals, said signal generating means (75, 78), said first and second sensors (4, 16) and said memory cooperating in said control means (35) for operating said reversible drive means to selectively drive said first, second, and third belt means (5, 6, 10) so that the direction of rotation of said drive means is in accordance with said selected folding program based on said sheet length signal as communicated to said memory by said signal generating means (75, 78), and wherein said drive means (8, 8') comprise a controlled motor (8') for driving said sheet supply rollers (3) at a controlled speed in said sheet feeding direction, and a reversible stepping motor (8) for operating said first belt means (5), said second belt means (6), and said third belt means (10) in a direction of rotation and in rotary steps in response to said control means (35) for folding a sheet in accordance with said selected one program.

2. The apparatus of claim 1, wherein said parallel positioned first belt means and said third belt means terminate at a folding exit region (18'), said apparatus further comprising a crossfolding device (26) and a direct exit for sheets not to be crossfolded, a sheet directing switch (18) located in said folding exit region (18') for selectively directing a folded sheet to said crossfold system (26) and to said direct exit, means connecting said sheet directing switch (18) to said control means (35) for operating said sheet directing switch by said control means (35), said apparatus further including transport means (24, 28) located downstream of said sheet directing switch (18) as viewed in said sheet travel direction for transporting a folded sheet to said crossfolding device (26), and wherein said crossfolding device comprises a crossfolding blade (32), a pair of crossfolding rollers (34) defining a nip between said folding rollers, said folding blade being movable into said nip for pushing a prefolded sheet between said crossfolding rollers (34) to form a crossfold, and wherein said crossfolding device (26) is physically positioned above an inlet region (2, 2') for said sheet leading to said pair of supply rollers (3).

3. The apparatus of claim 1, wherein axes of rotation (25) of said pair of driven supply rollers (3) are offset with respect to adjacent axes (11) of rotation of deflection rollers (12) of said first and second belt means (5, 6) for feeding a sheet (9) at an inclination through a gap between said first and second belt means and for directing said sheet into said folding gap (14) in a predetermined direction.

4. The apparatus of claim 1, wherein said first, second, and third belt means of said folding system are vertically arranged, whereby said planes will extend in a vertical direction.

5. An apparatus for folding large, essentially rectangular sheets (9) by forming one or more fold lines across the sheet, comprising a folding system (5, 6, 10) for folding said sheets, a pair of driven sheet supply rollers (3) for feeding sheets in a feeding direction (B) into said folding system, said folding system including a first belt means (5) operating in a first plane, a second belt means (6) longitudinally spaced from said first belt means and operating essentially in said first plane, a third belt means (10) operating in a second plane, parallel to said first plane, spaced therefrom for defining a folding gap (14) between said planes, reversible drive means (8, 8') coupled to said belt means for driving said belt means, and control means (35) for controlling an operation of said drive means for selectively reversing a travel direction of said belt means, said apparatus further comprising sensor means positioned to determine when a leading edge (17) of a sheet (9) passes the sensor means for providing an "edge present" signal, keyboard means (78) for generating a sheet length output signal representative of the length of a sheet delivered from a printer to said folding system, memory means for storing a plurality of folding programs defining the number and position of fold lines to be formed on a sheet in dependence on a longitudinal dimension of a sheet as represented by said sheet length output signal generated by said keyboard means (78), conductor means interconnecting said keyboard means (78), said sensor means and said memory (50) with said control means (35) for said drive means for controlling said drive means to selectively control said first, second, and third belt means (5, 6, 10), said drive means (8, 8') comprising a motor (8') controlled by said control means (35) for driving said sheet supply rollers (3) at a controlled speed for feeding sheets in said sheet feeding direction, and a reversible stepping motor (8) controlled by said control means (35) for operating said first belt means (5), said second belt means (6), and said third belt means (10) in a direction of rotation and by rotary steps in response to a selected folding program as determined by said sheet length output signal, wherein said belt means (5, 6, 10) of said folding system are vertically arranged, whereby said planes will extend in a vertical direction, wherein said parallel positioned first belt means and third belt means terminate at a folding exit region (18'), said apparatus further comprising a crossfold device (26) and a direct exit for sheets not to be crossfolded, and a sheet directing switch (18) located in said folding exit region (18') for selectively directing a folded sheet to said crossfolding device (26) and to said direct exit, and means connecting said sheet direction switch (18) to said control means for controlling the position of said sheet directing switch by said control means (35), whereby a sheet is folded in accordance with said selected one program.

* * * * *